US012557878B2

(12) United States Patent
Werremeyer et al.

(10) Patent No.: US 12,557,878 B2
(45) Date of Patent: Feb. 24, 2026

(54) FOOTWEAR SOLE ASSEMBLY

(71) Applicant: Xelero Technology, LLC, Hillsborough, NJ (US)

(72) Inventors: Daniel Werremeyer, Hillsborough, NJ (US); Robert Tighe, Easton, PA (US)

(73) Assignee: Xelero Technology, LLC, Hillsborough, NJ (US)

( * ) Notice: Subject to any disclaimer, the term of this patent is extended or adjusted under 35 U.S.C. 154(b) by 0 days.

(21) Appl. No.: 18/440,654

(22) Filed: Feb. 13, 2024

(65) Prior Publication Data

US 2024/0268519 A1 Aug. 15, 2024

Related U.S. Application Data

(60) Provisional application No. 63/484,655, filed on Feb. 13, 2023.

(51) Int. Cl.
*A43B 17/00* (2006.01)

(52) U.S. Cl.
CPC ..... *A43B 17/006* (2013.01)

(58) Field of Classification Search
None
See application file for complete search history.

(56) References Cited

U.S. PATENT DOCUMENTS 4,372,059 A * 2/1983 Ambrose ..... A43B 13/184 36/103
7,082,697 B2 * 8/2006 Ellis, III ..... F04F 5/02 36/25 R
7,941,940 B2 * 5/2011 Teteriatnikov ..... A43B 13/188 36/31
8,266,825 B2 * 9/2012 Pfister ..... A43B 21/26 36/28
8,316,558 B2 * 11/2012 Teteriatnikov ..... A43B 13/145 36/31
8,474,154 B2 7/2013 Werremeyer
8,959,798 B2 * 2/2015 Pfister ..... A43B 13/125 36/25 R
9,770,066 B2 * 9/2017 Grelle ..... A43B 13/127
10,709,200 B2 * 7/2020 Nurse ..... A43B 7/141
2004/0250447 A1 * 12/2004 Ellis, III ..... F04F 5/04 36/114
2010/0263228 A1 * 10/2010 Kang ..... A43B 13/20 36/29
2010/0307028 A1 * 12/2010 Teteriatnikov ..... A43B 13/145 36/108
2011/0072690 A1 * 3/2011 Teteriatnikov ..... A43B 13/188 36/30 R
2011/0154689 A1 * 6/2011 Chung ..... A43B 13/12 36/28

(Continued)

*Primary Examiner* — Jila M Mohandesi
(74) *Attorney, Agent, or Firm* — Michael J. Brown

(57) ABSTRACT

A footwear sole assembly with upper and lower layers, where the upper layer has a firmer durometer than the lower layer. Upon a user's heel strike, the difference in resilience between the upper and lower layers causes the upper layer to compress the lower layer. Sidewalls in the upper layer are urged toward each other on the heel strike, providing cradling support for the user's heel. The rigidness of the sidewalls of the upper layer also encourages the foot to propel through the stride, especially with the addition of a rolling element along the side of the footwear.

4 Claims, 6 Drawing Sheets

(56) References Cited

U.S. PATENT DOCUMENTS

| | | | | |
|---|---|---|---|---|
| 2014/0047740 | A1* | 2/2014 | Tucker | A43B 13/223 36/83 |
| 2014/0230281 | A1* | 8/2014 | Engell | A43B 13/14 36/102 |
| 2016/0345668 | A1* | 12/2016 | Dyer | A43B 13/186 |
| 2017/0105472 | A1* | 4/2017 | Lee | A43B 13/026 |
| 2019/0261734 | A1* | 8/2019 | Hansen | B32B 3/02 |
| 2020/0245717 | A1* | 8/2020 | Fusco | A43B 13/183 |

* cited by examiner

FOOTWEAR SOLE ASSEMBLY

PRIORITY

This application claims the benefit of U.S. provisional patent application No. 63/484,655, filed on Feb. 13, 2023, which is incorporated by reference.

FIELD OF INVENTION

This invention is in the field of orthopedic footwear sole assemblies used to improve stride stability of the user.

BACKGROUND

The ground contact of a foot during a stride involves the steps of: (1) heel contact; (2) forefoot loading; (3) mid-stance; and (4) propulsion. At heel contact, the foot absorbs shock and may pronate or supinate to maintain contact with the ground. Pronation is when the foot turns inward and supination is when the foot turns outward.

Prior art footwear assemblies provide for a softer or cushioned upper sole element, with a rigid lower sole element or outsole which absorbs and disperses the impact of a heel strike. While a softer upper sole element may provide a more comfortable feel for the user, the softness comes at the cost of lesser stability.

Prior art footwear, in particular sandal type footwear, is often constructed with a single density foam with a single durometer, where the density of the foam is soft for providing a cushioned feel for the user's feet. However, the softness of the foam and associated flexibility does not provide support for the foot, preventing use as orthopedic footwear.

Orthotic stabilizers are known to provide additional support for the foot within footwear. Often such stabilizers are additional elements that must be inserted into existing footwear, and often require a counter and full shoe upper to keep them in position.

In U.S. Pat. No. 8,474,154, the inventors disclose an improved footwear outsole to provide stability for the foot during stride, providing guidance from heel strike to toe off, and preventing pronation and supination. However, the inventors recognize that their prior invention does not meet the need for foot support in footwear that does not include significant heel support. The prior invention also does not provide cushioning for the heel.

It is the purpose of the present invention to provide an orthotic sole assembly for incorporation in footwear to cushion the heel and to stabilize the foot during the stride.

An object of the present invention is to retain the advantages of walking with a rolling action while at the same time providing enhanced cushioning and support at heel strike. It is important that the footwear of the invention differs as little as possible in external appearance from traditional shoes. In particular, an object of the invention is to enable a controlled dynamic, rolling gait.

Another objective of the invention is to provide greater foot support for footwear which has little or no heel counter or wall such as sandals.

SUMMARY

A sole assembly for footwear, with an upper layer and a lower layer, where the upper layer has a firmer durometer than the lower layer. The material of the upper layer is harder or more resilient than the material of the lower layer. The hardness ratio of the two materials can be selected as desired and adapted according to need. It can thereby be ensured that the shoe behaves according to known principles such that walking or running, with a balance of cushioning and stability, takes place naturally. Moreover, stable forward propulsion is promoted in this way. It will be understood by those skilled in the art that these elements may be constructed from conventional materials such as molded elastomers.

The bottom surface of the upper layer presents a concave face toward a convex top of the lower layer. The footbed of the upper layer is thin in the center of the heel region and thickens toward the medial and lateral sides. The change in thickness in the upper layer provides support to the foot at the heel during heel strike, by creating a cantilever.

The upper layer provides a cantilever built into lower concave surface, with cushioning of the lower layer below the heel to absorb shock of impact. Unlike existing footwear, the cushioning of a softer durometer is not adjacent to the user's heel, but rather in the convex lower layer. The lower layer provides a cushion for the more rigid upper layer, specifically where the rigid upper layer presents a thin section directly under the heel. The combination of a concave profile of the upper layer in the heel area with a convex profile in the softer lower layer ensures greater walking stability with enhanced cushioning.

The present invention also puts a rolling element into the sole assembly of footwear. The sole assembly can be designed such that it contains this rolling element in an integrated way. The rolling element extends along at least a portion of the side of the footwear, and presents a curve directed downward, starting at the heel area and ending in the midfoot area. The rolling element is made at least partially of an elastic material, for example an elastomer such as rubber or polyurethane. The rolling element provides enhanced heel-to-toe motion during a stride, from heel strike to toe off.

The material of the rolling element is harder or more resilient than the material of the lower layer, and is preferably integrated with the upper layer at the heel. The hardness ratio of the two materials can be selected as desired and adapted according to need. It can thereby be ensured that the footwear behaves according to the known principle such that the walking or running with a rolling action takes place naturally. Moreover the rolling of the stride is promoted in this way.

The rolling element can be on both sides of the sole assembly. Unlike the rolling element in U.S. Pat. No. 8,474,154, because the present invention includes a thinner upper layer at the heel strike area, the rolling element is not present through the center of the upper layer. The rolling element enables the required rolling action of the foot during the stride.

Figure 1:
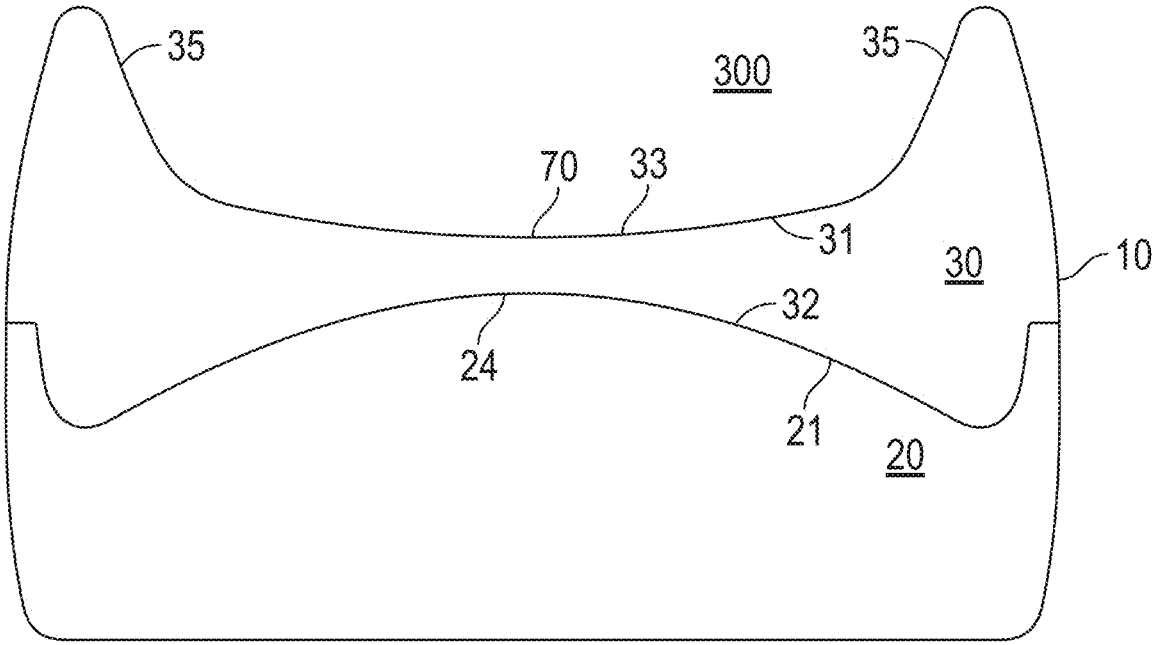
FIG. 1 is a rear cross-section view of a heel portion of a preferred embodiment of the sole assembly.

The attached drawings are for illustrative purposes only, and are provided in order to aid an understanding of the invention. The figures are not intended to convey a limitation or definition of the claimed invention.

DETAILED DESCRIPTION

The invention is a sole assembly 10 consisting of two layers of material with different durometers, an upper layer 30 and a lower layer 20

Upper layer 30 has an upper surface 31 capable of receiving the heel of a user's foot, and with side walls 35, forms an area 300 for receiving a user's heel. Area 300 is shaped similar to footwear heel areas as is known in the art. Lower surface 32 is concave for engaging the upper surface 21 of lower layer 20. At the heel strike area 70 of upper layer 30, the cross section presents a tapered center 33 between upper surface 31 and lower surface 32.

Lower layer 20 has a convex upper surface 21. The center of upper surface 21 forms a raised center 24. Lower layer 20 may rest upon an outsole, or may itself comprise the outsole. Lower layer 20 is composed of a resilient material capable of compression upon pressure, and returning to its original shape upon the release of pressure. Examples of such material include rubber, foam, and other pliable materials, including those containing air pockets or cells.

Upper layer 30 has a firmer durometer than lower layer 20. The firmer durometer of the upper layer allows for offloading of pressures evenly upon the lower layer. Upper layer presents "U" cross section, where the sides of the upper layer cradle the heel, and provide medial-lateral support for the foot. The medial-lateral support of the upper layer prevents both pronation and supination, keeping the foot in a neutral position.

Figure 2:
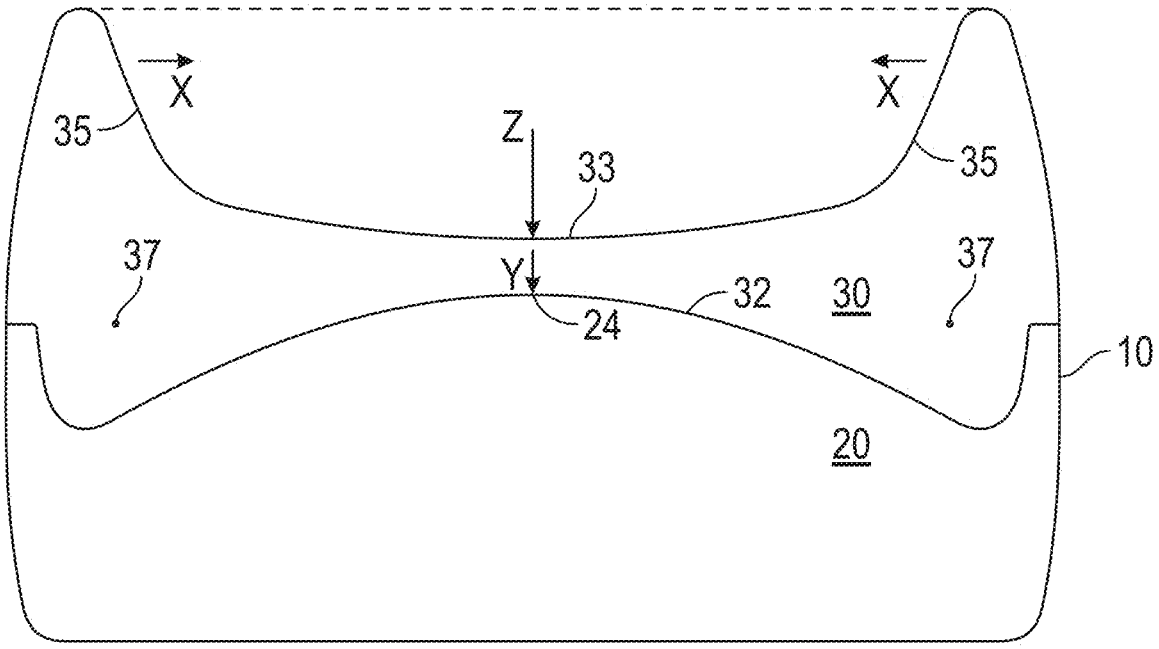
FIG. 2 is a rear cross-section view of a preferred embodiment showing force vectors applied to the sole assembly at the beginning of a heel strike.

Upon heel strike during a user's stride, the pressure of the user's heel forces upper layer 30 toward lower layer 20. In particular, center 33 is urged toward raised center 24. FIG. 2 shows the anticipated force vectors at heel strike. Lower layer 20, being of a softer durometer than upper layer 30, will compress more than upper layer 30. As lower layer 20, and specifically raised center 24, compresses, tapered center 33 moves downward, as shown by vectors Y and Z. The downward movement of tapered center 33 causes side walls 35 of upper layer 30 to move inward toward the user's heel, as shown by vector X, providing lateral support for the user's heel. The movement of side walls 35 is caused by the firmer durometer of upper layer 30 acting as twin levers, with imaginary fulcrums located at points 37 of upper layer 30.

Figure 3:
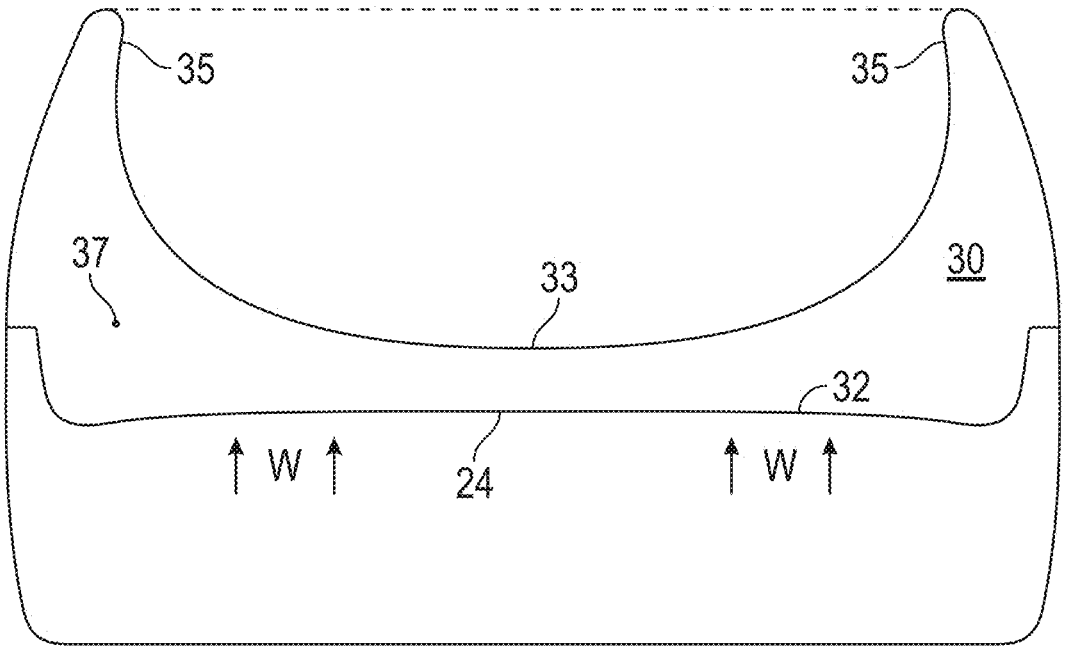
FIG. 3 is a rear cross-section view of a preferred embodiment showing the effect of a heel strike applied to the sole assembly.
Figure 4:
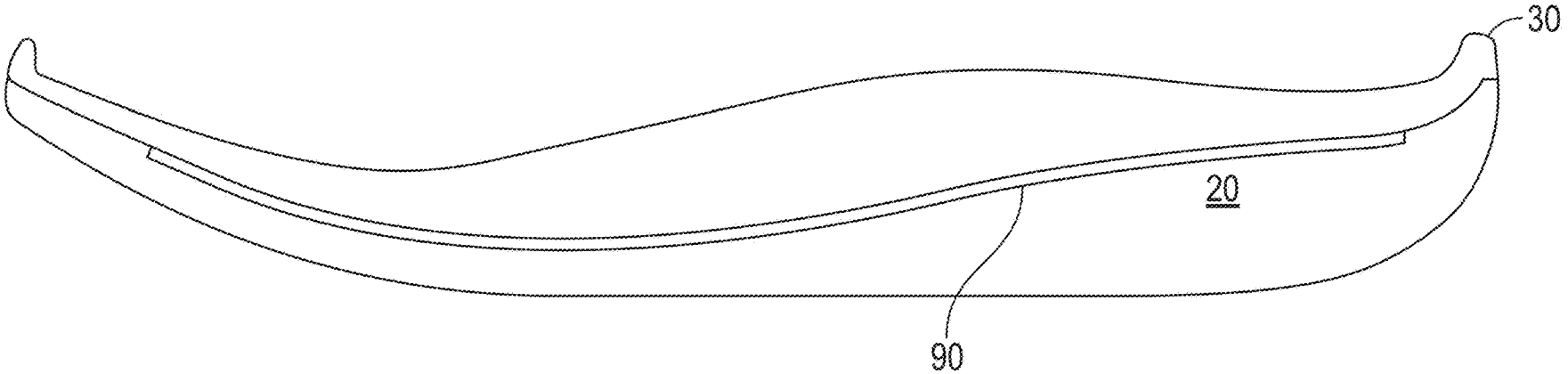
FIG. 4 is a side cross-section view along line B-B of FIG. 7.

In FIG. 3, the compression of lower layer 20 is shown, with vector W indicating the stored compression energy directed upward. In FIG. 3, lower layer 20 is shown compressed. Upper layer 30 is shown in FIG. 3 in a lower position than in FIGS. 1 and 2, and side walls 35 are shown inward from their resting position.

Providing the thinnest part of the upper layer over the thickest part of the lower layer allows the tapered center 33 to press down into raised center 24, while the firm durometer of upper layer 30 causes both sides to pivot around points 37, thereby causing the side walls 35 to move inward and cradle the heel while the foot is on the ground.

The lateral support for the user's heel caused by the inward movement of side walls 35 provides greater stability for the user's stride, during the moment in the stride where a larger portion of the user's weight is supported by the foot.

The compression of the lower layer 20 upon heel strike creates stored energy due to a resistance of the lower layer against said compression. As the user's stride progresses toward toe lift, and pressure on the heel area decreases, the stored energy in lower layer 20 helps push against the user's heel, providing a bounce or propulsion effect.

The more rigid upper layer provides stability to the user's foot, and the lower layer absorbs impact forces and provides cushioning during a step or stride. The upper layer extends over the sides of the shoe upper, as well as downward, partially wrapping the lower layer for added stability. Thanks to a continuous profile of the upper layer over the entire width of the shoe, greater walking stability can be ensured. The curve of the upper layer's lower surface, from heel to toe, promotes a rolling effect. The rigidity of the upper layer, sometimes enhanced by way of control plate 90, minimizes flexion of the forefoot, promoting greater propulsion at toe-off. The combination of these characteristics provides the foot with a proper guidance system throughout the gait cycle.

Figure 5:
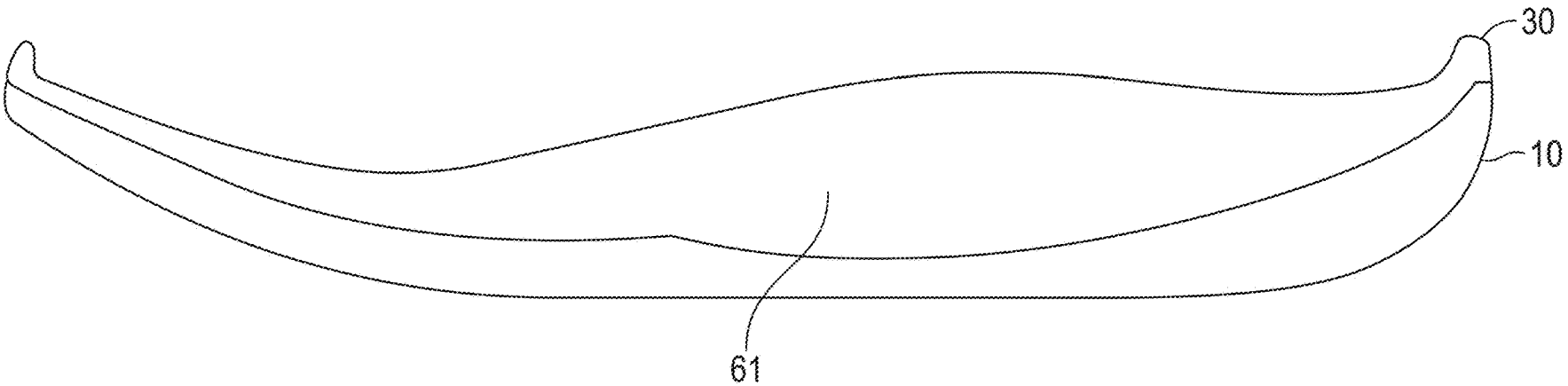
FIG. 5 is a cross-section view along line A-A of FIG. 7, showing the rolling element.

In one embodiment, rolling element 61 is provided along the medial or lateral side of the sole assembly, as shown in FIG. 5, above the outsole. Rolling element 61 is preferably shaped with a convex curve extending downward toward the outsole along the length of the footwear, angling downward from the heel area. Rolling element 61 preferably is formed of the same material as upper layer 30. It is important for the rolling element 61 to be of a more resilient material than the lower layer. The lower surface of rolling element 61 should be convex to enable the required rolling action.

The combination of rolling element 61 with the stored compression energy within lower layer 20 provides a greater propulsive effect than without rolling element 61.

Figure 6:
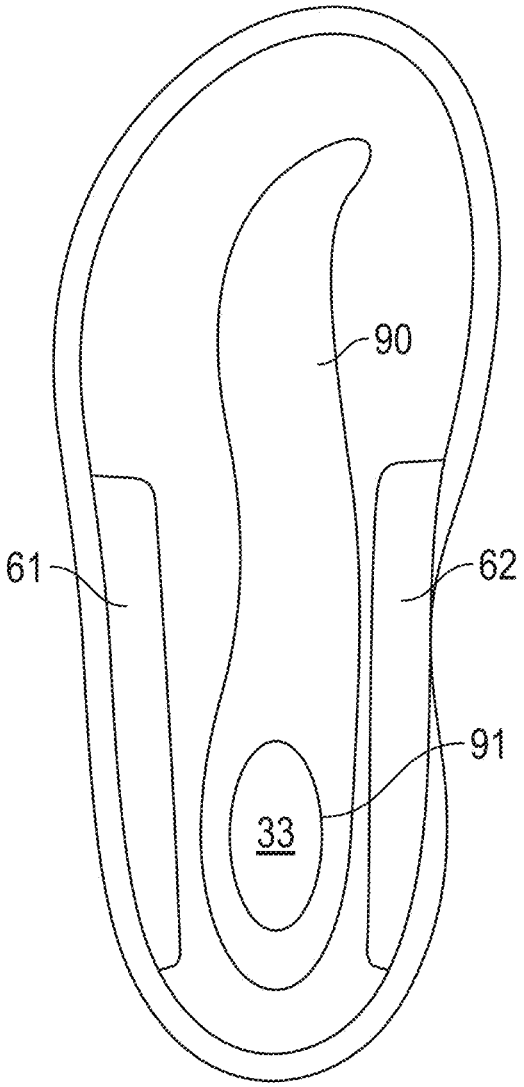
FIG. 6 is a top cross-section view of the sole assembly, showing an alternate embodiment with a rolling element.
Figure 7:
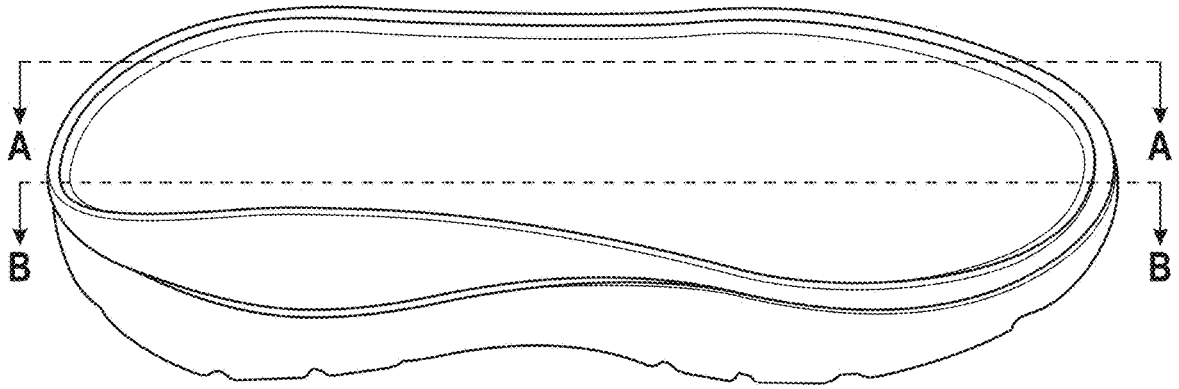
FIG. 7 is a perspective view of the sole assembly.
Figure 8:
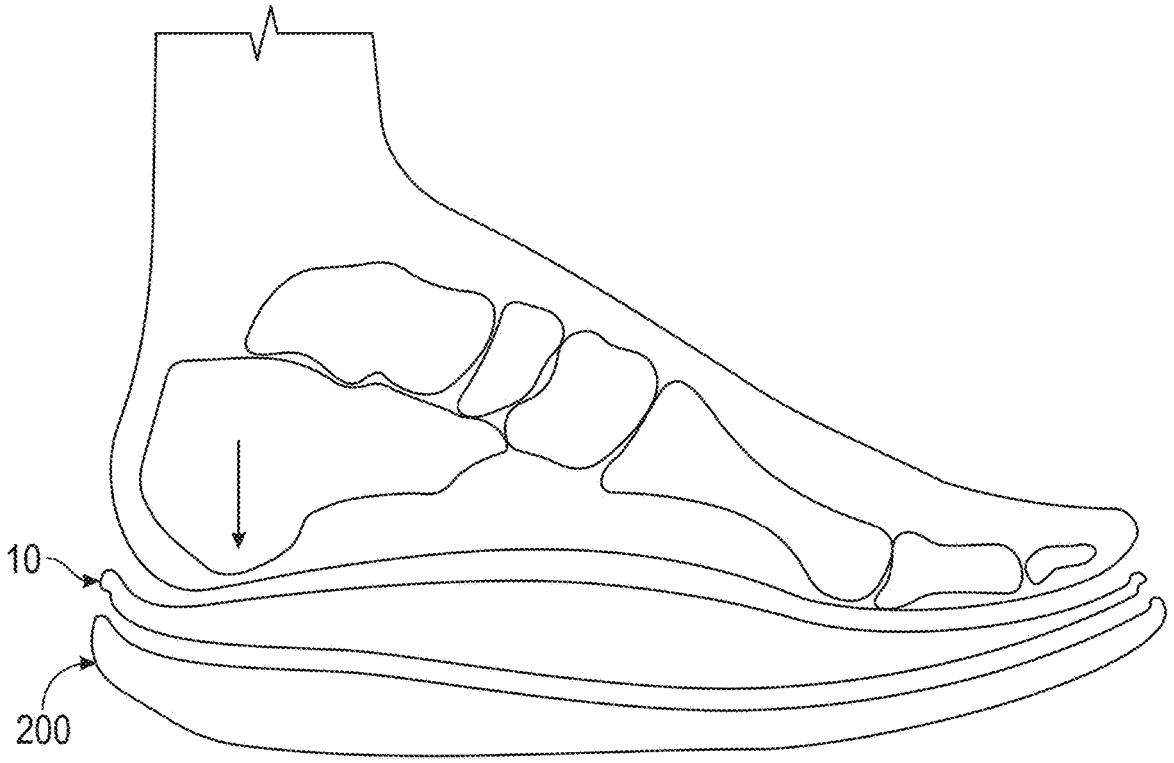
FIG. 8 is an exploded cross-section view of the sole assembly, showing the relative placement of a user's foot, with the bones of the foot shown for context.
Figure 11:
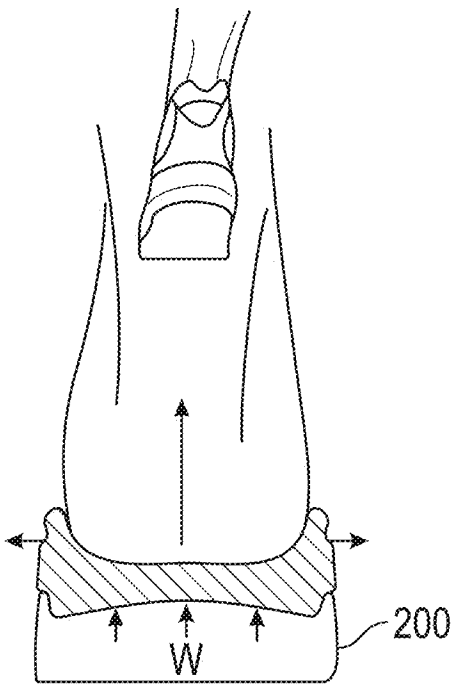
FIG. 11 is a cross-section view of the heel area of the sole assembly after heel strike.
Figure 10:
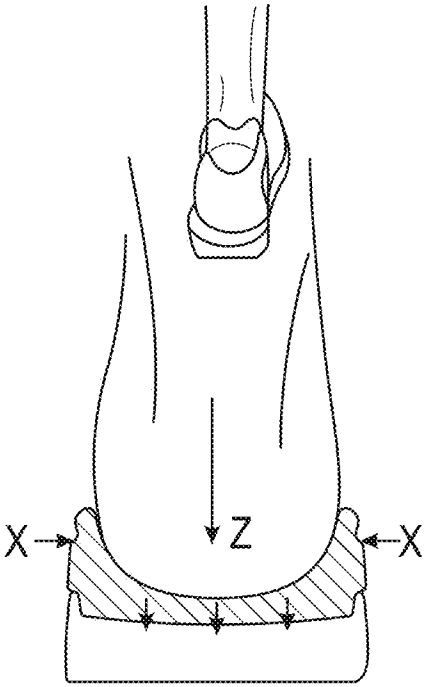
FIG. 10 is a cross-section view of the heel area of the shoe assembly during heel strike.
Figure 9:
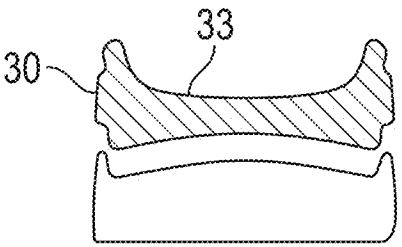
FIG. 9 is an exploded cross-section view of the heel area of the sole assembly.

As shown in FIG. 6, a second rolling element 62 is preferably placed on the opposite side of the footwear, mirroring rolling element 61, and allowing for a balanced effect.

In an alternate embodiment, rigid support 90 extends from the heel of the sole assembly toward the ball of the foot area of the sole assembly. Rigid support 90 includes opening 91 at the heel strike area, allowing for a comfortable feel for the user's heel, while still providing for compression of lower layer 20. Rigid support 90 provides longitudinal support for the sole assembly, preventing the softness of the sole assembly from lessening the stability of the footwear, and helps transfer some of the rotational forces of rolling element 61 to be absorbed into lower layer 20 and diffuse the load forces of the user's stride.

Rigid support 90 also provides torsional stability and reduces flexion in toe off of the user's stride. Rigid support 90 may also provide therapeutic relief for the following conditions: forefoot neuropathy, hallux ridgus, metatarsalgia, and plantar fasciitis.

The unique design benefits the foot, ankle, knee, hip and lower back by promoting forward motion and providing rearfoot guidance, support, and stability under the foot. In particular, the design promotes stability for a user's stride in three phases of the stride.

At heel strike, the design is uniquely suited to help both pronation and supination via the harder durometer footbed which dynamically cradles the rearfoot and subtly cradling the heel during the normal gate cycle. No other footwear has this design element or provides the functionality. The unique convex design of the harder durometer upper footbed, engages at heel strike, when compressed against the softer lower layer, and promotes forward motion. While at the same time, the softer lower half of the outsole provides shock absorption.

At midstance, the firmer top layer footbed cradles the rearfoot and adds torsional stability through the midfoot, providing better balance by guiding the foot forward in a neutral position to keep the foot, ankle, knees and hips in alignment.

At toe off, the harder footbed stiffens the forefoot, providing stability and reducing forefoot flexion.

While certain novel features of the present invention have been shown and described, it will be understood that various omissions, substitutions and changes in the forms and details of the device illustrated and in its operation can be made by those skilled in the art without departing from the spirit of the invention.

We claim:

1. A sole assembly for footwear comprising a lower layer with a bottom surface extending across the heel area of footwear on an outsole, and a convex upper surface, the lower layer having a first durometer;

an upper layer with a concave bottom surface resting upon the convex upper surface of the lower layer, and a concave upper surface capable of receiving a user's heel, the upper layer having a second durometer, where the second durometer is greater than the first durometer;

where at the heel area the upper layer presents a tapered cross section between interior and exterior side walls of the heel area, forming a cradle for a user's heel;

the upper layer further comprising an elongated side extending from the heel area toward a toe area of the footwear, the elongated side having a convex bottom forming a rolling element tapering at the heel and toe areas; and where the elongated side is integrated with the lateral side walls.

2. The sole assembly for footwear of claim 1, further comprising a rigid support extending from a heel area of the footwear toward a toe area of the footwear, the rigid support having an opening around the center of the convex upper surface of the lower layer.

3. The sole assembly for footwear of claim 1, the upper layer further comprising an elongated rolling element integrated into a side wall, the elongated rolling element having a first end at the heel area of the footwear, and a second end at a midfoot area of the footwear, where the rolling element presents a convex face directed toward the lower layer.

4. The sole assembly for footwear of claim 1, further comprising where upon heel strike of a stride, the heel strike causes downward pressure to be applied to the upper layer at the tapered cross section, said pressure compresses the convex upper surface of the lower layer, causing the side walls of the upper layer to pivot inward toward the tapered cross section of the upper layer.

* * * * *